United States Patent [19]

Benninger et al.

[11] 4,212,715

[45] Jul. 15, 1980

[54] PROCESS FOR REDUCING LOSSES OF MERCURY IN ALKALI METAL CHLORIDE ELECTROLYSIS

[75] Inventors: Siegfried Benninger, Schwalbach; Adolf Schmidt, Kriftel, both of Fed. Rep. of Germany

[73] Assignee: Hoechst Aktiengesellschaft, Frankfurt, Fed. Rep. of Germany

[21] Appl. No.: 20,086

[22] Filed: Mar. 13, 1979

Related U.S. Application Data

[63] Continuation-in-part of Ser. No. 942,266, Sep. 14, 1978, abandoned.

[30] Foreign Application Priority Data

Sep. 17, 1977 [DE] Fed. Rep. of Germany ..... 2741985

[51] Int. Cl.[2] ..... C25B 1/36

[52] U.S. Cl. ..... 204/99

[58] Field of Search ..... 204/99

[56] References Cited

U.S. PATENT DOCUMENTS 1389870 4/1975 GBX .

FOREIGN PATENT DOCUMENTS

| | | |
|---|---|---|
| 916866 | 1/1963 | United Kingdom . |
| 932337 | 7/1963 | United Kingdom . |
| 1154420 | 6/1969 | United Kingdom . |
| 1339261 | 11/1973 | United Kingdom . |
| 1375656 | 11/1974 | United Kingdom . |
| 1389870 | 4/1975 | United Kingdom . |
| 1392331 | 4/1975 | United Kingdom . |
| 1439803 | 6/1976 | United Kingdom . |

*Primary Examiner*—R. L. Andrews

*Attorney, Agent, or Firm*—Curtis, Morris & Safford

[57] ABSTRACT

Brine (an aqueous solution of alkali metal chlorine) which is electrolyzed according to the amalgamation process, generally contains small amounts of mercury. It has been found that these traces of mercury are entrained with the evaporated water in a considerable amount when applying evaporation cooling to the brine. In order to keep these losses as low as possible, a pH of from 7 to 9.0 and a redox potential more than $1391-6.66(pH)-5.94(pH)^2$ but not more than 1100 mV (based on the potential of the hydrogen electrode) is adjusted by adding chlorine or alkali metal hypochlorite and optionally alkali metal hydroxide to the brine.

5 Claims, No Drawings

PROCESS FOR REDUCING LOSSES OF MERCURY IN ALKALI METAL CHLORIDE ELECTROLYSIS

This is a continuation-in-part application of application Ser. No. 942,266 filed Sept. 14, 1978, now abandoned.

The present invention relates to a process for reducing vaporous mercury emissions from hot thin brine obtained during the electrolysis of aqueous alkali metal chloride solutions according to the amalgamation process. This electrolysis comprises producing alkali metal hydroxide and chlorine from a substantially saturated solution of an alkali metal chloride(brine) under the action of a direct current. Electrolysis occurs in cells containing a moving mercury cathode, on which the alkali metal deposits while forming an amalgam. The alkali metal-containing mercury is reacted with water in a decomposer to yield alkali metal hydroxide solution and hydrogen and is recycled to the electrolysis cell.

For reasons of environmental protection, alkali metal chloride electrolyses are exclusively performed in closed brine circuits nowadays, that is to say, the salt consumed in the cells is made up by anew saturating the thin brine with solid salt.

In the electrolysis of sodium chloride, the brine leaving the cell usually contains from 1 to 20 mg/l of mercury, from 265 to 290 g of sodium chloride and (depending on the temperature) from 300 to 600 mg of chlorine per liter.

For removing the chlorine, the thin brine is acidified to a pH of from 2 to 3 with hydrochloric acid and is subjected to a vacuum. Thereafter, from 10 to 30 mg of chlorine are still dissolved. This quantity may be further reduced, however. A content of from 20 to 30 mg of chlorine per liter of brine is considered as being sufficient to make sure that metallic mercury does not pass into the atmosphere or into the filtration sludge (cf. Ullmann, Encyklopädie der technischen Chemie, 3rd edition, volume 9 (1975), page 340). After dechlorination, sodium hydroxide solution is anew added in order to neutralize the hydrochloric acid. Generally a pH of from 9.5 to 11 is adjusted during the neutralization in order to enable magnesium salts to precipitate completely in a subsequent stage.

The brine leaving the electrolysis cell must be cooled in order to remove the heat which is produced during electrolysis (heat loss). Without cooling, the working temperature would rise above from 60° to about 90° C. during electrolysis. Since the feed quantity of water in the electrolysis is generally greater than the quantity of water which leaves the brine system, water must be evaporated additionally to attain a water equilibrium. For this reason, an open evaporation cooling system is mounted in the brine circuit system in practice. Thus, hot thin brine may be sprayed onto salt in open salt beds. In this process, the salt is dissolved whereas water is evaporated. This process makes a particularly simple discharge of the insoluble matrix of the salt possible. Generally the evaporation is carried out at a temperature in the range from 60° to 80° C.

When using closed rapid saturators, there are employed separate evaporation coolers, which are preferably charged with thin brine (dechlorinated and alkalized) to avoid salt crystallizations.

The present invention is based on the observation that in the direct evaporation cooling of the hot brine considerable quantities of mercury are contained in the hot brine vapors. For example, according to measurements of the applicant, about 14 mg of mercury are removed during the evaporation of brine (containing per liter 10 mg of mercury, 270 g of sodium chloride, 10 mg of chlorine; pH 10, temperature 70° C.) per liter of evaporated water. (These data are based on the simultaneous measurement of the mercury and water concentration in the evaporating brines. The absolute losses of mercury may be deduced from the known quantity of evaporated water). Depending on the quantity of water to be evaporated, a loss of mercury of up to 15 g per ton of produced chlorine may be incurred in accordance with the above data. It was, surprising that evaporating brines containing mercury may cause mercury emissions. It was to be expected according to the indications of Gmelin (cf. Handbuch der anorganischen Chemie, syst. No. 34(B), page 545) that losses of mercury would not occur during the evaporation provided that the solution contains a considerable excess of alkali metal chloride.

It was certainly known that brines always contain mercury. However, the processes for reducing losses of mercury in brine systems which had been elaborated hitherto, only intended to reduce losses in filtration residues obtained during the precipitation purification of brine (cf. German Auslegeschriften Nos. 1,767,026 and 2,214,479). These mercury-containing filtration residues are obtained when thin brine is saturated with crude sodium chloride and when the crude brine is liberated from calcium, magnesium and sulfate by adding sodium hydroxide solution, soda and barium carbonate.

The problem of reducing the losses of mercury during evaporation is solved according to the invention by adjusting the redox potential of the hot brine arriving in the open evaporation cooler at a value of at least 800 millivolts (calculated on the voltage of the standard hydrogen electrode).

Experiments carried out by the applicant showed a linear connection between the redox potential of the brine (expressed in mV, calculated on the voltage of the standard hydrogen electrode) and the logarithm of the mercury content of the vapor above the brine.

In the following table there are compared some experimentally determined values for the losses of mercury with the redox potential of brine solutions. Columns 1 to 3 show the pH-value, the chlorine content and the redox potential $E_R$ (based on the voltage of a standard hydrogen electrode) of the solution and column 4 shows the loss of mercury calculated on the evaporated quantity of water (brine: temperature 70° C., 270 g/liter sodium chloride, about 10 mg/liter mercury).

TABLE

| brine parameters | | | losses of mercury |
|---|---|---|---|
| pH | mg $Cl_2$/l | $E_R$ (mV) | mg Hg/l $H_2O$ |
| 9.0 | 0 | 215 | 35.0 |
| 9.0 | 20 | 829 | 0.25 |
| 9.0 | 30 | 848 | 0.22 |
| 9.0 | 40 | 855 | 0.21 |
| 9.0 | 51.3 | 870 | 0.19 |
| 9.5 | 51.3 | 811 | 0.30 |
| 8.5 | 95 | 903 | 0.14 |
| 8.3 | 65 | 906 | 0.14 |
| 7.5 | 90 | 1048 | 0.05 |

In the case of a constant pH-value, the redox potential of the brine may be increased by adding chlorine or alkali metal hypochlorite. Thus, an addition of 100 mg of chlorine per liter at pH 7 will be sufficient to adjust the redox potential to a value of about 1100 mV. If the pH is 11.8, only half of the above redox potential is obtained with the same amount of chlorine.

The redox potential may alternatively be influenced in the case of a given chlorine content by changing the pH. It is increased by adding hydrochloric acid and is reduced by adding alkali metal hydroxide.

Since the volatility of the dissolved chlorine is increased with a reduced pH-value, the process may be performed without considerable losses of chlorine only at pH-values of at least 7. Higher pH-values require higher concentrations of hypochlorite, in order to attain a redox potential of at least 800 mV. It should be taken into account that further increases of the hypochlorite concentration only slightly affect the redox potential owing to their logarithmic influence thereon. There is a great danger of chlorate formations in the case of high hypochlorite concentrations. Therefore, pH-values of at most 9.8 and a redox potential of at most 1100 mV should be considered as limits for technical applications. When using 100, 50, 30, 10 and 5 mg of chlorine per liter of brine, the redox potential of the brine for a pH in the range of from 7 to 9.8 may be represented by the following equations (in mV, based on the standard hydrogen electrode):

100 mg/l chlorine:
$$E_R = 939 + 110.3 \cdot (pH) - 12.74 \cdot (pH)^2$$

50 mg/l chlorine: $E_R = 1387 - 1.46(pH) - 6.16 \cdot (pH)^2$ 30 mg/l chlorine: $E_R = 1391 - 6.66(pH) - 5.94 \cdot (pH)^2$ 10 mg/l chlorine: $E_R = 1815 - 112.5(pH)$ 5 mg/l chlorine: $E_R = 1621 - 110.6(pH)$ Preferably at most 100, especially at most 50 and at least 10 mg, more especially more than 30 mg of chlorine per liter of brine should be used. The preferred upper limit of the pH is 9.0, especially 8.5, and the preferred lower limit 8.0. The process may be used for the electrolysis of sodium chloride as well as for the electrolysis of potassium chloride, the use in the sodium chloride electrolysis being preferred.

It may occur that the reproducibility of the redox potential values is, very low. This is, inter alia, due to the history of the measuring electrode and to potential shiftings of the reference electrode (standard hydrogen electrode). Furthermore, the redox potential itself is gradually reduced because of the slow decomposition of the hypochlorite ions.

However, a sufficient reproducibility of the data may be obtained when applying the following method: In order to avoid a diffusion of the electrolyte to be examined into KCl solution of the reference electrode, a separate reference electrode (calomel or Ag/AgCl) which is connected with the solution to be examined via an electrolyte bridge should be used. This arrangement permits a better reproducibility than a single stick measuring cascade. The hydrostatic pressure of the KCl solution of the reference electrode should be higher than in the electrolyte to be measured.

The measuring electrode made from platinum should be in contact for at least 2 hours prior to measuring with a solution, the temperature and the composition of which (chloride,hypochlorite) should be as similar as possible to that of the solution to be examined. The electrolyte should be stirred during the measurement.

What is claimed is:

1. A process for reducing loss of mercury in an alkali metal chloride electrolysis plant operating according to the amalgamation process and including an open brine evaporation cooling system, which comprises adjusting the redox potential $E_R$ of the brine to be evaporated so that the value of said redox potential is more than $1391 - 6.66\ (pH) - 5.94\ (pH)^2$ millivolts, but not more than 1100 millivolts, based on the voltage of a standard hydrogen electrode, and the pH of the brine is of from 7.0 to 9.0; and evaporating the brine in the open brine evaporation cooling system.

2. A process as claimed in claim 1, wherein the value of the redox potential of the brine is less than or equal to $939 + 110.3\ (pH) - 12.74\ (pH)^2$.

3. A process as claimed in claim 2, wherein the value of the redox potential of the brine is less than or equal to $1387 - 1.46\ (pH) - 6.16\ (pH)^2$.

4. A process as claimed in claim 1, wherein the brine is a sodium chloride brine.

5. A process as claimed in claim 1, wherein the pH of the brine is at most 8.5.

* * * * *